US007509814B2

(12) United States Patent
Xu

(10) Patent No.: US 7,509,814 B2
(45) Date of Patent: Mar. 31, 2009

(54) COMPACT INTEGRATED BUFFER FOR PULSE TUBE REFRIGERATOR

(75) Inventor: Mingyao Xu, Emmaus, PA (US)

(73) Assignees: Sumitomo Heavy Industries, Ltd., Tokyo (JP); SHI-APD Cryogenics, Inc., Allentown, PA (US)

( * ) Notice: Subject to any disclaimer, the term of this patent is extended or adjusted under 35 U.S.C. 154(b) by 325 days.

(21) Appl. No.: 11/334,034

(22) Filed: Jan. 18, 2006

(65) Prior Publication Data

US 2007/0163272 A1 Jul. 19, 2007

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS

| | | | | |
|---|---|---|---|---|
| 3,237,421 | A | 3/1966 | Gifford | |
| 3,620,029 | A | 11/1971 | Longsworth | |
| 5,107,683 | A | 4/1992 | Chan et al. | |
| 5,295,355 | A | 3/1994 | Zhou et al. | |
| 5,335,505 | A | 8/1994 | Ohtani et al. | |
| 5,412,952 | A | 5/1995 | Ohtani et al. | |
| 6,256,997 | B1 | 7/2001 | Longsworth | |
| 6,256,998 | B1 | 7/2001 | Gao | |
| 6,343,475 | B1 | 2/2002 | Ishikawa | |
| 6,378,312 | B1 * | 4/2002 | Wang | 62/6 |
| 6,434,947 | B2 | 8/2002 | Zhu et al. | |
| 2004/0017117 | A1 * | 1/2004 | Kwon et al. | 310/61 |
| 2005/0000232 | A1 * | 1/2005 | Longsworth | 62/6 |

OTHER PUBLICATIONS

E.I. Mikulin et al. "Low-Temperature Expansion Pulse Tubes" Advances in Cryogenic Engineering, vol. 29, p. 629-637, 1984.
S. Zhu et al. "Double Inlet Pulse Tube Refrigerators: An Important Improvement" Cryogenics, vol. 30, p. 514, 1990.

* cited by examiner

*Primary Examiner*—William C Doerrler
(74) *Attorney, Agent, or Firm*—Katten Muchin Rosenman LLP

(57) ABSTRACT

A range of buffer volume/pulse tube volume ratios for two-stage hybrid GM type pulse tube cold-heads that are designed to produce refrigeration at 4 K are provided. The ranges of volume ratios for the first and second stages provides a good balance between the inefficiencies but compact size of a four-valve phase shifting mechanism and the better efficiency but larger size of a double-orifice phase shifting mechanism. The buffer volumes are small enough to be conveniently machined into the warm end housing, or as an option, one can be part of a valve disc housing. The drive motor for the valve disc is in an attached housing to make the valve disc readily accessible for service.

17 Claims, 3 Drawing Sheets

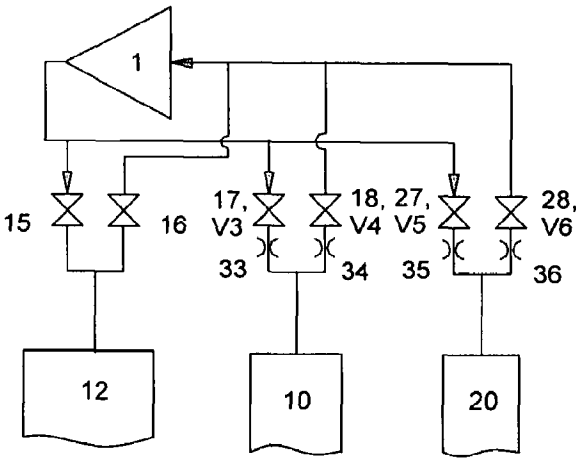
FIG. 1b - FOUR VALVE
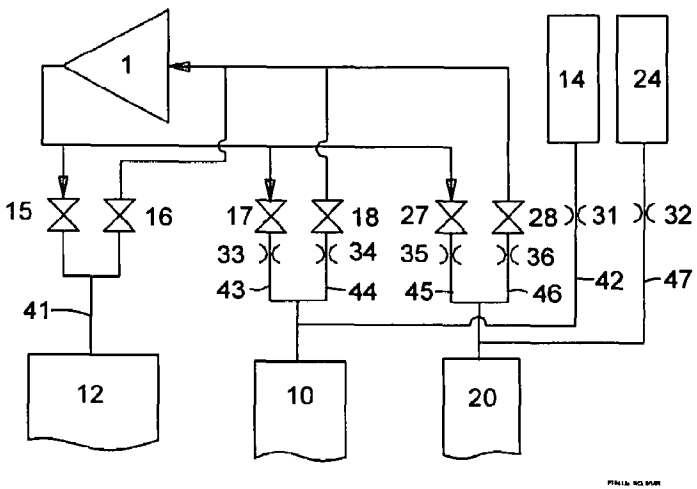
FIG. 1c - HYBRID
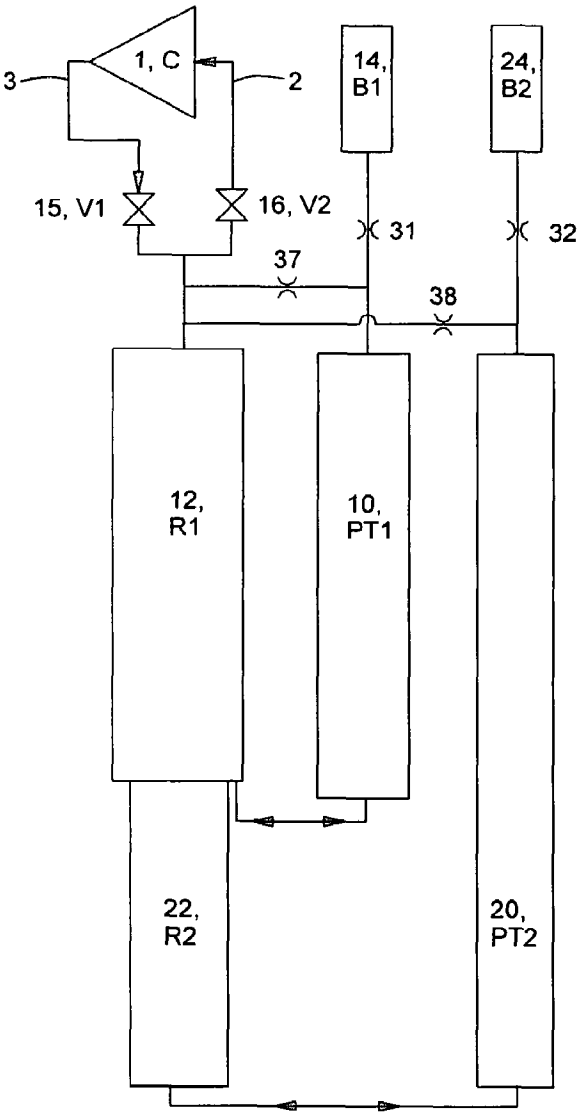
FIG. 1a - DOUBLE ORIFICE

COMPACT INTEGRATED BUFFER FOR PULSE TUBE REFRIGERATOR

BACKGROUND OF THE INVENTION

The present invention relates to cryogenic refrigerators, in particular, GM type pulse tube refrigerators. This type of refrigerator is comprised of a compressor unit that is connected by gas lines to an expander unit, commonly referred to as a cold-head. Two-stage GM type pulse tubes running at low speed are typically used for applications below about 20 K. It has been found that best performance at 4 K has been obtained with the pulse tube shown in FIG. 9 of U.S. Pat. No. 6,256,998. This design has six valves which open and close in the sequence shown in FIG. 11 of that patent. It contains a good description of the mechanism for producing refrigeration at very low temperatures and the important role that the valves and buffer volumes play in shaping the P-V diagram, FIG. 10, to maximize the refrigeration produced per cycle. The relationship between the displacement of the gas and the cycling of the pressure that is seen in the P-V diagram is usually referred to as phase shifting.

The first pulse tube refrigerator was described by W. E. Gifford in U.S. Pat. No. 3,237,421. A significant improvement in performance was made by E. I. Mikulin, A. A. Tarasow and M. P. Shkrebyonock, '*Low temperature expansion (orifice type) pulse tube*', Advances in Cryogenic Engineering, Vol. 29, 1984, p. 629-637 in 1984, when they added an orifice and buffer volume to the warm end of the pulse tube. This improved the phase shifting. S. Zhu and P. Wu, '*Double inlet pulse tube refrigerators: an important improvement*', Cryogenics, vol. 30, 1990, p. 514, made a further improvement by adding a second orifice between the warm end of the pulse tube and the inlet to the regenerator. The application of the "double-orifice" principal to a two-stage pulse tube enabled the production of refrigeration below 4 K. Production of refrigeration below 4 K has also been achieved by means of a "four-valve" pulse tube as described in U.S. Pat. No. 5,335,505 and U.S. Pat. No. 5,412,952. The first patent describes single stage pulse tubes and the second describes two-stage pulse tubes. Phase shifting is achieved by the timing of opening and closing the valves between the warm ends of the pulse tubes and the lines to and from the compressor relative to the timing of the valves between the warm end of the regenerator and the lines to and from the compressor. U.S. Pat. No. 5,412,952 describes the addition of buffer volumes connected to the warm ends of the two pulse tubes, with fixed orifices in each connecting line.

The valve timing described in U.S. Pat. No. 6,256,998 has been found to be more effective than the timing described in U.S. Pat. No. 5,412,952. U.S. Pat. No. 6,256,998 refers to the combination of "four-valve" control, with buffers and fixed orifices, as a "hybrid" pulse tube. It is to be noted that a "fixed" orifice may be adjustable, so that it can be set in a fixed position when the pulse tube is manufactured.

The four-valve pulse tube is more compact than a double-orifice pulse tube because it does not have buffer volumes; however it is less efficient because all of the phase shifting flow comes from the compressor. Most of the phase shifting flow in the double-orifice pulse tube is exchanged between the buffer volumes and the pulse tubes. A hybrid pulse tube is more efficient than a four-valve pulse tube and can have smaller buffer volumes than a double-orifice pulse tube. The buffer volumes can range in size from almost the zero volume of a four-valve pulse tube to almost the same size as a double-orifice pulse tube would have. Buffer volumes are defined relative to the corresponding pulse tube volumes as a ratio.

One of the objects of this invention is to define the volumes for first-stage and second-stage buffers of a two-stage hybrid pulse tube that have been found to provide a good balance between efficiency and size. Another object of this invention is to integrate the buffer volumes into the warm end housing of the pulse tube cold-head assembly.

Some of the concepts that are incorporated in current pulse tube cold-heads are shown in U.S. Pat. No. 3,620,029. This is an early pneumatically driven GM type expander in which the motion of the displacer is controlled by gas flowing through a fixed orifice between the top of the displacer cylinder and a buffer volume. FIG. 7 of this patent shows a valve motor, in a separate housing, driving a rotary valve, that cycles flow at high pressure from a compressor to a regenerator, then returns it from the regenerator to the compressor at low pressure. The buffer volume is shown in a housing that is separate from the valve motor housing and the valve disc housing. If the displacer were to be removed from the cylinder, the cold-head would become a single orifice pulse tube. In actual practice the buffer volume has been integrated into the valve disc housing as shown in FIG. 1A of U.S. Pat. No. 6,256,997. Many pulse tube patents show the buffer volumes as being separated from the cold head by connecting tubes, e.g. U.S. Pat. No. 5,107,683, U.S. Pat. No. 5,295,355, U.S. Pat. No. 6,256,998, U.S. Pat. No. 6,343,475 and U.S. Pat. No. 6,434,947.

U.S. Pat. No. 6,378,312 describes a means of integrating one or more buffer volumes, orifices, a valve mechanism, and a valve motor within an integral housing; a housing which has several machined chambers. The pressure oscillation controller, which is usually a rotary valve disk in contact with a valve seat, has to be replaced or repaired when maintenance is needed. This integral configuration has the disadvantage of more difficult maintenance than a cold-head with more direct access to a rotary valve disc.

SUMMARY OF THE INVENTION

It has been found that the relatively small buffer volumes of the two-stage hybrid pulse tube make it practical to integrate them into the warm housing, with the option of having one in a valve disc housing, and having the valve motor in an attached housing. This combines the benefits of compactness and ease of maintenance. The valve motor assembly can be mounted inline with the pulse tubes or at right angles. The primary near term application is the cooling of MRI magnets that use low temperature superconducting wire, and operate at 4 K.

However, work is being done on devices that use high temperature superconducting wire and will operate near 30 K. Although present magnets require two-stage pulse tubes, future applications may use single stage pulse tubes. Single stage pulse tubes operate in the same manner as the first stage of a two-stage pulse tube. Thus, the invention disclosed herein may also be applied to a single stage pulse tube.

This invention defines a range of buffer volume/pulse tube volume ratios for two-stage hybrid GM type pulse tube cold-heads that are designed to produce refrigeration at 4 K. The ranges of volume ratios for the first and second stages provides a good balance between the inefficiencies but compact size of a four-valve phase shifting mechanism and the better efficiency but larger size of a double-orifice phase shifting mechanism. The buffer volumes are small enough to be conveniently machined into the warm end housing, or as an option, one can be part of a valve disc housing. The drive motor for the valve disc is in an attached housing to make the valve disc readily accessible for service.

BRIEF DESCRIPTION OF THE DRAWINGS

FIGS. 1*a*, 1*b*, and 1*c* are schematics of double-orifice, four-valve, and hybrid GM type pulse tube refrigerators.

DETAILED DESCRIPTION OF THE INVENTION

Figure 2:
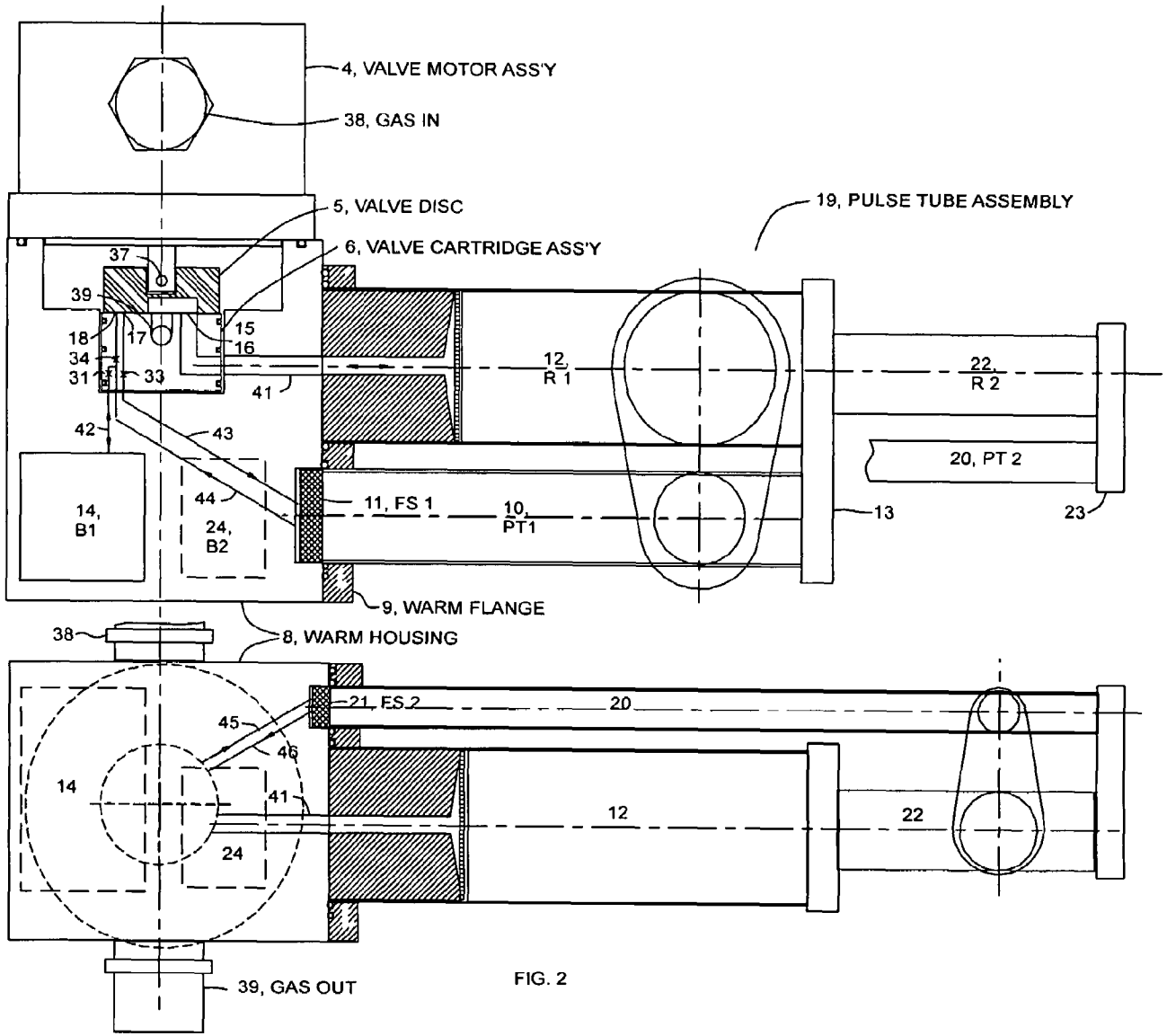
FIG. 2 is a simplified cross section of a two-stage hybrid GM type pulse tube cold-head which shows a first embodiment of the present invention. It has both buffer volumes and the valve disc in the warm end housing and the valve motor assembly at right angles to the pulse tubes.

The present invention is applicable to one-stage and two-stage hybrid G-M type pulse tube refrigerators. Like numbers in the figures refer to like parts.

FIGS. 1*a*, 1*b*, and 1*c* are schematics of double-orifice, four-valve, and hybrid GM type pulse tube refrigerators. Compressor assembly 1, supplies gas (e.g. helium) at high pressure through line 3 to valve V1, 15, and receives gas from valve V2, 16, through line 2 at low pressure. Valves V1 and V2 open and close in sequence to cycle gas in and out of regenerator R1, 12. When valve V2 is open, gas flow is split at the cold end of R1, some flows into the cold end of first-stage pulse tube PT1, 10, and the rest flows into the warm end of regenerator R2, 22. Some of this gas stays in R2 and some flows out the cold end of R2 into the cold end of second-stage pulse tube PT2, 20. After valve V1 closes, valve V2 opens and the flow is reversed. This process is common to all three types of pulse tubes.

Phase shifting is accomplished in the double-orifice control mechanism of FIG. 1*a* by means of gas cycling through lines that connect from the warm end of regenerator 12 to the warm ends of pulse tubes 10 and 20 through orifices 37, and 38, respectively, in combination with gas cycling between the warm ends of pulse tubes 10 and 20, to buffer volumes B1, 14 and B2, 24, through orifices 31, and 32, respectively.

Phase shifting is accomplished in the four-valve control mechanism of FIG. 1*b* by means of gas cycling into the warm ends of pulse tubes 10 and 20, from compressor supply line 3 through valves V3, 17, and V5, 27, and returning to compressor return line 2 through valves V4, 18, and V6, 28, respectively. The rate of flow through valves V3, V4, V5, and V6, is set by fixed orifices 33, 34, 35, and 36, respectively.

Phase shifting is accomplished in the hybrid control mechanism of FIG. 1*c* by means of gas cycling into the warm ends of pulse tubes 10 and 20 from buffer volumes 14 and 24 through orifices 31 and 32 followed by gas from compressor supply line 3 flowing through valves 17 and 27, then returning to buffer volumes 14 and 24 through orifices 31 and 32 followed by gas returning to compressor return line 2 through valves 18 and 28, respectively. The rate of flow through valves 17, 18, 27, and 28, is set by fixed orifices 33, 34, 35, and 36, respectively. A preferred timing sequence for these valves is shown in FIG. 11 of U.S. Pat. No. 6,256,998.

It will be understood by one skilled in the art that four-valve control requires all of the phase shifting gas to come from the compressor and that it is the most compact of the three phase shifting mechanisms. It is also understood that double-orifice control is the least compact of the three mechanisms and that both double-orifice and hybrid control require some gas from the compressor.

While the fraction of the compressor flow that is used to control phase shifting is an important factor in effecting efficiency it is not the only factor. Other factors include the timing of flow and the rate of flow to and from the warm ends of the pulse tubes. Practical factors include the ability to set the size of an orifice during manufacturing, and the long term temperature stability during operation.

The amount of gas required for phase shifting at the warm end of the pulse tube relative to the amount of gas that flows in and out of the cold end of the pulse tube is dependent on the cold end temperature. For example at 60 K the ratio is about 1 to 4, at 40 K it is about 1 to 6, and at 4 K it is about 1 to 30.

A two-stage GM type pulse tube cold-head that is designed to cool a superconducting MRI (magnetic resonance imaging) magnet will typically produce refrigeration at 40 K and 4 K. The reduction in flow direct from the compressor by the use of buffer volumes is less important than the other factors discussed above.

Both double-orifice and hybrid control systems have been studied for two-stage GM type pulse tubes designed to cool MRI magnets. Both systems work. At the present time the hybrid system is favored because of its relatively compact size, good efficiency, and good operating stability. Tests have been run with different size buffer volumes.

Results of tests for two-stage GM type pulse tube refrigerators designed for MRI cooling are summarized in the TABLE 1. Volumes are expressed as a ratio of the buffer volume to the pulse tube volume.

TABLE 1

| Cold Head Type | Double-Orifice | Hybrid |
|---|---|---|
| First stage volume ratio, minimum | 5.0 | 0.5 |
| First stage volume ratio, preferred | 5.5 | 2.2 |
| Second stage volume ratio, minimum | 3.0 | 0.2 |
| Second stage volume ratio, preferred | 3.5 | 0.7 |

The hybrid type pulse tube is less sensitive to buffer volume size than the double orifice type because more gas flow to the warm end of the pulse tube can come direct from the compressor when the volume is small. TABLE 2 shows the effect on temperature for a hybrid type pulse tube with 40 W and 1 W heat loads on the first and second stages respectively.

TABLE 2

| Stage | Volume Ratio | Temperature - K |
|---|---|---|
| First stage | 0.5 | 34.4 |
| First stage | 2.2 | 33.7 |
| Second stage | 0.2 | 4.25 |
| Second stage | 0.7 | 4.15 |

FIG. 2 is a simplified cross section of a first embodiment of the present invention. Valve motor assembly 4 is attached to warm housing 8 which is attached to the warm flange 9 of two-stage pulse tube assembly 19. Pulse tube assembly 19 consists of first stage regenerator 12, first stage pulse tube 10, first stage warm flow smoother 11, first stage heat station 13, second stage regenerator 22, second stage pulse tube 20, second stage warm flow smoother 21, and second stage heat station 23. Valve motor assembly 4 includes a motor with a drive shaft and drive pin 37. Gas inlet port 38 is shown as part of valve motor assembly 4 but may be part warm housing 8. Drive pin 37 turns valve disc 5 which rotates on a valve seat that is shown as part of valve cartridge assembly 6. Examples of valve port patterns and options for different valve disc and valve seat designs are described in U.S. Ser. No. 60/537,661 and 60/544,144.

Warm housing 8 is shown as containing first stage buffer volume 14, second stage buffer volume 24, valve cartridge assembly 6, gas passage 41 from ports 15 and 16, in the valve seat face of 6, through fixed orifice 33 to first stage regenerator 12, gas passage 43 from valve port 17 to the warm end of first stage pulse tube 10 through flow smoother 11, gas passage 44 that returns gas from 10 to valve port 18 through adjustable orifice 34, and gas passage 42 that connects from 44 through fixed orifice 31 to first stage buffer volume 14. Valve cartridge assembly 6 also contains valve ports and orifices for the second stage, not shown, that are similar to those shown for the first stage. Gas passages 45 and 46 connect from 6 to second stage pulse tube 20 through flow smoother 21. Gas returns to the compressor at low pressure through passage and fitting 39.

This embodiment of the invention shows valve motor housing 4 attached to the side of warm housing 8 such that the axis of rotation is perpendicular to pulse tubes 10 and 20. Pulse tubes that operate at 4 K are preferably oriented with the cold end of the pulse down in order to avoid gas convection losses. The right angle orientation of the warm end assembly minimizes the height required above a MRI magnet to remove the pulse tube assembly.

Figure 3:
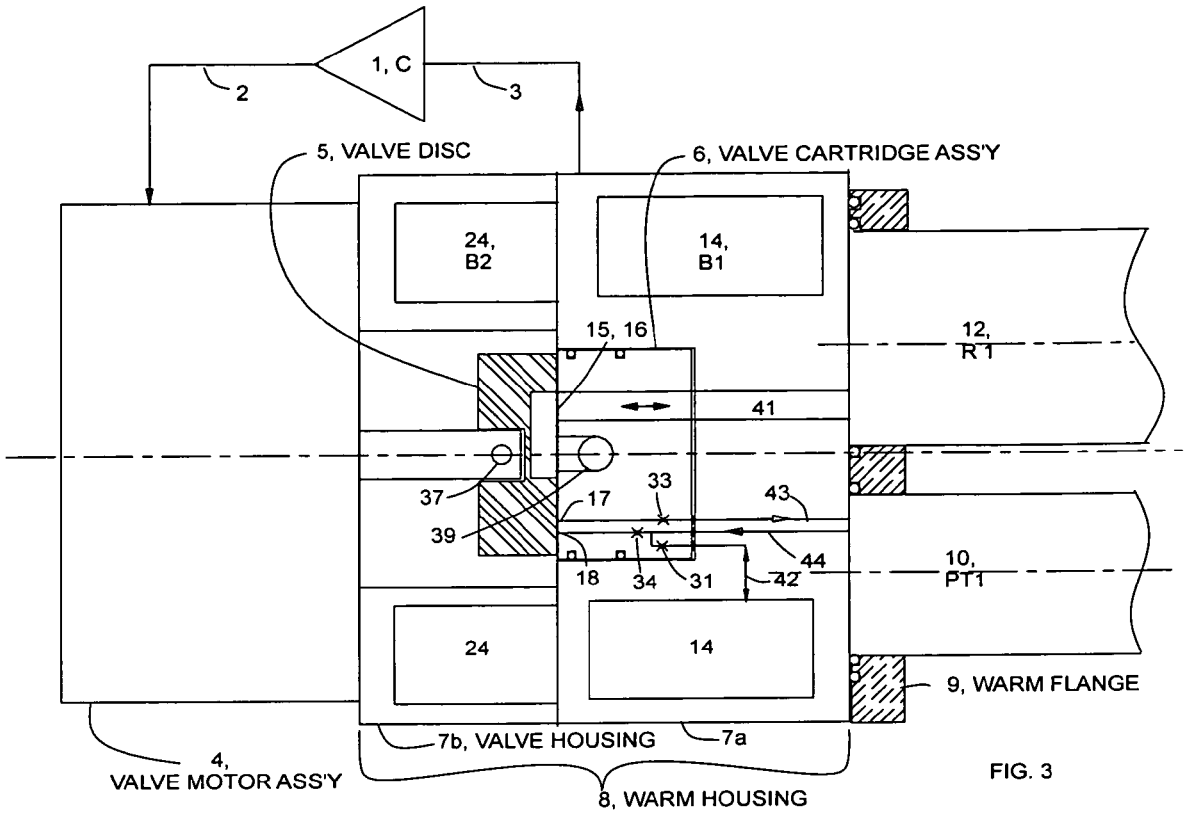
FIG. 3 is a second embodiment of a warm end housing with a first stage buffer, a valve disc housing with a second stage buffer, and an attached valve motor assembly. All of the components are in line with the pulse tubes.

FIG. 3 shows a second embodiment of this invention in which warm housing 8 is divided into a first part 7*a* and a valve housing 7*b* for valve disc 5. The warm end components are shown to be in line with the pulse tubes. The warm end of pulse tube assembly 19 is attached to warm housing 8 by warm flange 9 to which pulse tubes 10 and 20, not shown, and regenerator 12 are bonded. First stage buffer volume 14 is shown contained in 7*a*, the first part of warm housing 8, and second stage buffer volume 24 is shown contained in valve housing 7*b*. Valve cartridge assembly 6 and the gas passages in 8 are the same as shown in FIG. 2.

The configurations of the warm end components that are attached to pulse tube assembly 19, as shown in FIGS. 2 and 3, are to be taken as representative of other possible configurations in which compact buffer volumes are contained in a single or multi-piece warm housing, that also contains a rotary valve mechanism, and to which a separate drive motor assembly is attached.

The invention claimed is:

1. A GM pulse tube two stage hybrid type cold head comprising, a pulse tube assembly attached to a warm housing, the warm housing containing a first stage buffer volume and a second stage buffer volume, a valve motor assembly attached to the warm housing, where the second stage buffer has a volume relative to the volume of the second stage pulse tube between 0.5 and 0.9.

2. A GM pulse tube two stage hybrid type cold head comprising:

a pulse tube assembly attached to a warm housing, the warm housing containing a first stage buffer volume and a second stage buffer volume, a valve motor assembly attached to the warm housing, where the first stage buffer has a volume relative to the volume of the first stage pulse tube from about 1.75 to about 2.75 and the second stage buffer has a volume relative to the volume of the second stage pulse tube of from about 0.5 to about 0.9.

3. A GM pulse tube two stage hybrid type cold head comprising:

a pulse tube assembly attached to a warm housing, the warm housing containing a first stage buffer volume and a second stage buffer volume, a valve motor assembly attached to the warm housing, where the first stage buffer has a volume relative to the volume of the first stage pulse tube of about 2.2 and the second stage buffer has a volume relative to the volume of the second stage pulse tube of about 0.7.

4. The pulse tube of claim 2 in which the warm housing comprises a single piece.

5. The pulse tube of claim 2 in which the warm end housing comprises a first part and a valve housing.

6. The pulse tube of claim 5 in which one of the buffer volumes is in the first part of the warm housing and the other buffer volume is in the valve housing.

7. The pulse tube of claim 2 in which the axis of the valve motor assembly is at a right angle to the axis of the pulse tube assembly.

8. The pulse tube of claim 2 in which the axis of the valve motor assembly is in line with the axis of the pulse tube assembly.

9. A GM pulse tube one stage hybrid type cold head comprising, a pulse tube assembly detachably attached to a warm housing, the warm housing containing a first stage buffer volume, a valve motor assembly attached to the warm housing, where the first stage buffer has a volume relative to the volume of the first stage pulse tube between 0.5 and 1.

10. The pulse tube of claim 9 in which the warm housing comprises a single piece.

11. The pulse tube of claim 9 in which the warm end housing comprises a first part and a valve housing.

12. The pulse tube of claim 9 in which the axis of the valve motor assembly is at a right angle to the axis of the pulse tube assembly.

13. The pulse tube of claim 9 in which the axis of the valve motor assembly is in line with the axis of the pulse tube assembly.

14. The pulse tube of claim 2 in which the pulse tube assembly is detachably attached to the warm housing.

15. The pulse tube of claim 2 in which the valve motor assembly is detachably attached to the warm housing.

16. The pulse tube of claim 9 in which the pulse tube assembly is detachably attached to the warm housing.

17. The pulse tube of claim 9 in which the valve motor assembly is detachably attached to the warm housing.

* * * * *